United States Patent [19]

Koishi et al.

[11] Patent Number: 5,017,829

[45] Date of Patent: May 21, 1991

[54] FRAMING CAMERA

[75] Inventors: Musubu Koishi; Motoyuki Watanabe, both of Shizuoka, Japan

[73] Assignee: Hamamatsu Photonics Kabushiki Kaisha, Shizuoka, Japan

[21] Appl. No.: 314,736

[22] Filed: Feb. 24, 1989

[51] Int. Cl.[5] ..... H01J 31/26

[52] U.S. Cl. ..... 313/382; 313/415; 313/421; 313/529; 250/213 VT

[58] Field of Search ..... 313/373, 382, 415, 421, 313/527, 542, 529; 250/213 VT

[56] References Cited

U.S. PATENT DOCUMENTS 4,243,878 1/1981 Kalibjian ..... 313/529 X
4,467,189 8/1984 Tsuchiya ..... 313/529 X

FOREIGN PATENT DOCUMENTS 1016930 1/1966 United Kingdom .

OTHER PUBLICATIONS

Kalibjian et al., "Framing Camera Tube for Subnanosecond Imaging Applications:", Rev. Sci. Instrum., vol. 54, No. 12, Dec. 1983, pp. 1626–1628.

Kalibjian, "100-ps Framing-Camera Tube", Rev. Sci. Instrum., vol. 49, No. 7, Jul. 1978, pp. 891–896.

*Primary Examiner*—Donald J. Yusko
*Assistant Examiner*—Michael Horabik
*Attorney, Agent, or Firm*—Finnegan, Henderson, Farabow, Garrett, and Dunner

[57] ABSTRACT

A framing camera comprises a photocathode, a first deflection means for scanning electron beams emitted from the photocathode, a slit plate having a single slit for converting the electron beams with a spatial picture image information into electron beams with a picture image of temporal sequence and a second deflection means for scanning the electron beams passed from the slit plate to have them impinge upon a phosphor screeen to thereby produce a plurality of framed patterns, in which deflection voltages supplied to the first and second deflection means are adjustable independently of each other.

5 Claims, 4 Drawing Sheets

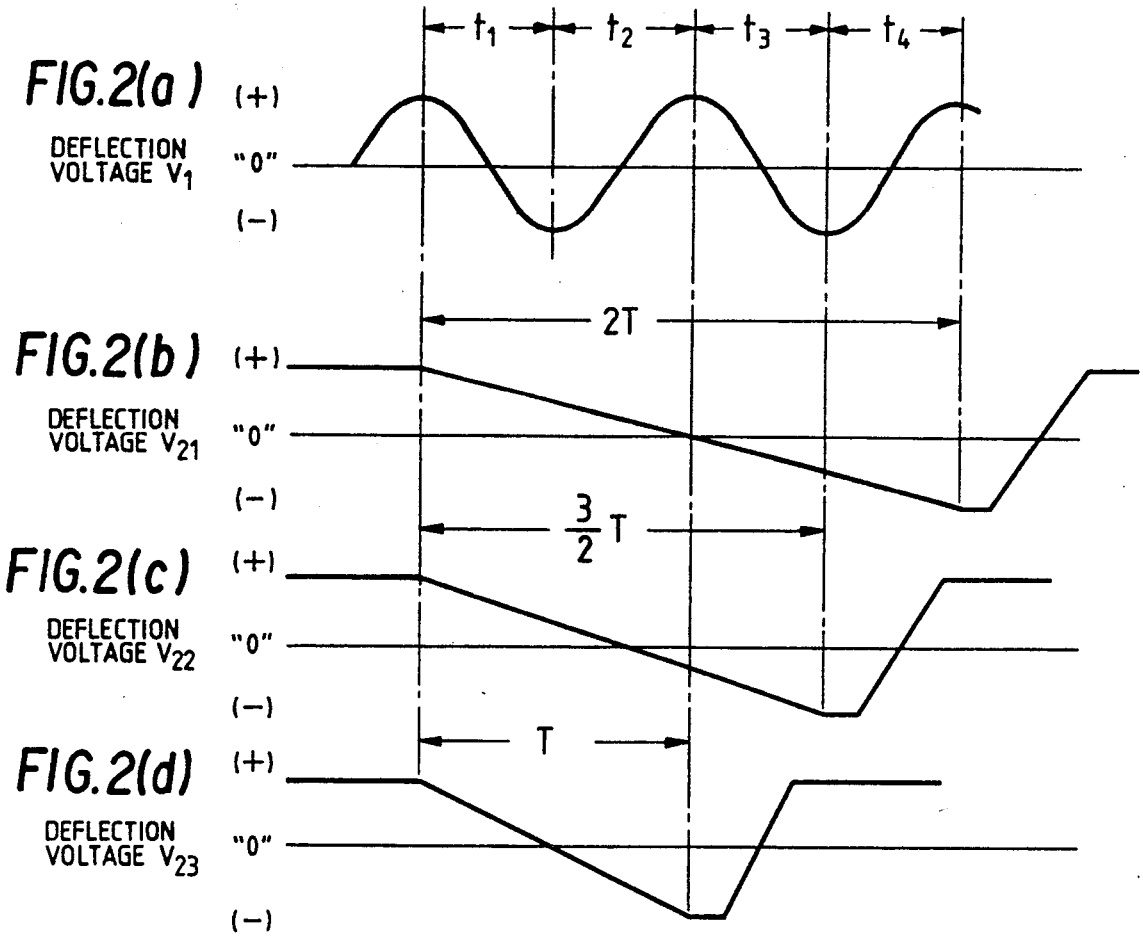
FIG. 3(a)
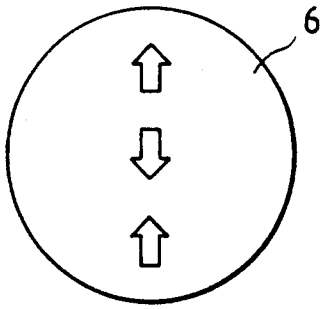
FIG. 3(b)
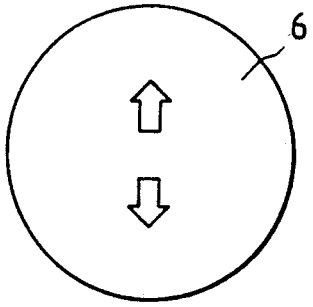

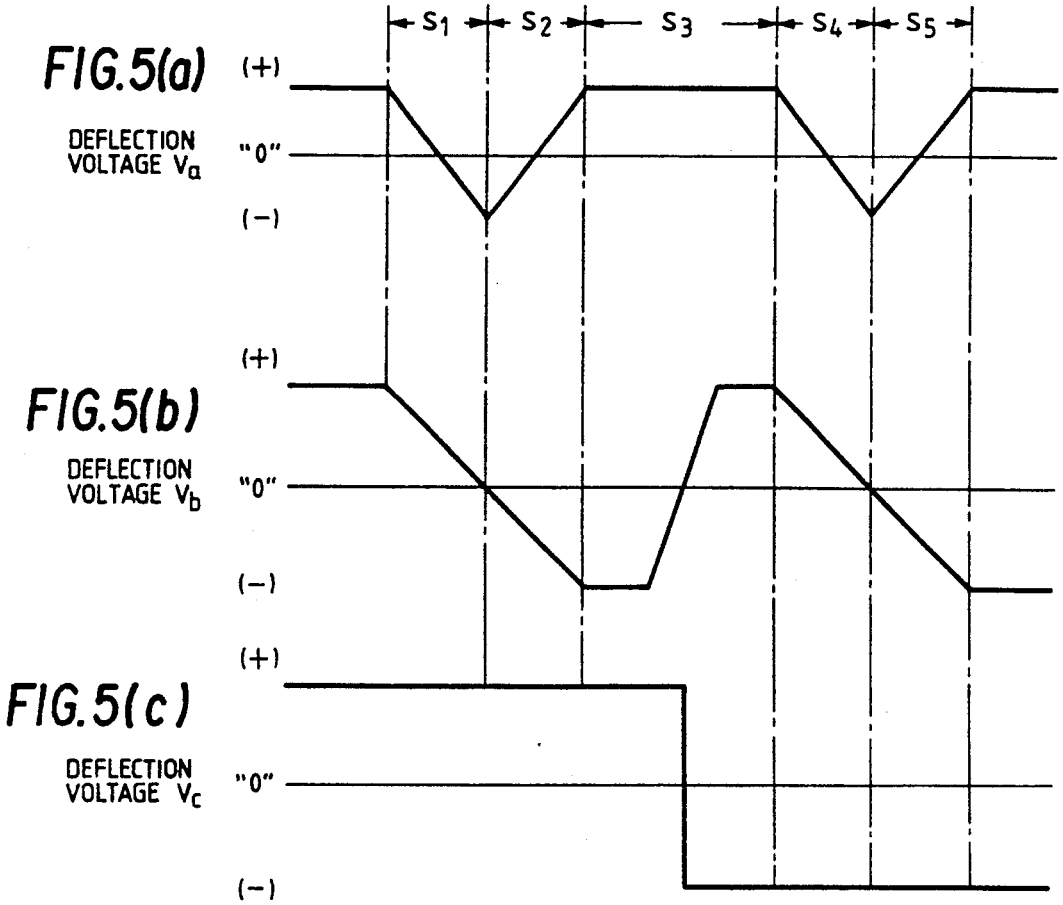
FIG. 6 PRIOR ART
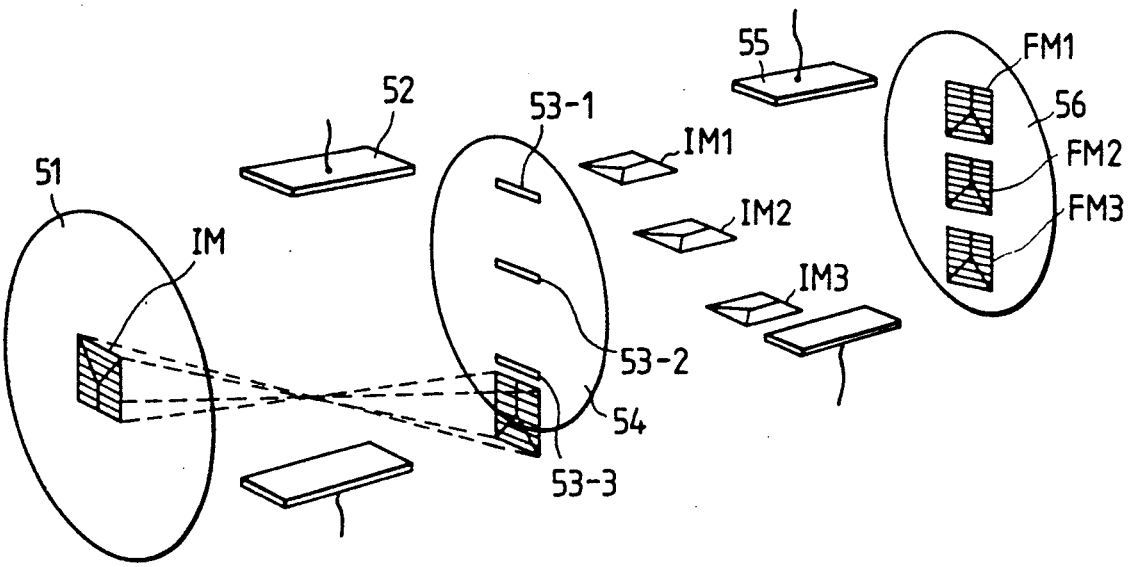

FRAMING CAMERA

BACKGROUND OF THE INVENTION

The present invention relates to a framing camera capable of producing a plurality of discrete framed patterns.

A framing camera is already known and an example is described by R. Kalibjian and S.W. Thomas in their article "Framing Camera Tube for Subnanosecond Imaging Applications", Rev. Sci. Instrum. 54 (12), December 1983, pp. 1626–1628.

FIG. 6 is a schematic representation of the constitution of the framing camera described in the above-cited reference. This framing camera consists essentially of a photocathode 51, a deflector 52 for scanning electron beams that have been emitted from the photocathode 51 in response to irradiation with a light beam carrying picture image information, an anode 54 having a plurality of slits 53-1 to 53-3, a deflector 55 for scanning electron beams that have passed through the slits 53-1 to 53-3 in the anode 54, and a phosphor screen 56 to be irradiated with the electron beams scanned with the deflector 55.

The operation of this framing camera proceeds as follows. Electron beams carrying information of a spatial picture image IM, that have been emitted from the photocathode 51, are scanned with the deflector 52 so as to sequentially pass through the slits 53-1 to 53-3 in the anode 54. By passing through the slits 53-1 to 53-3, electron beams having the picture image information as a temporal sequence are formed as shown by IM1 to IM3 and then directed toward the deflector 55. The deflector 55 performs another deflection of the electron beams to restore the picture image information of temporal sequence to the initial spatial picture image information before they irradiate the phosphor screen 56. As a result, a plurality of framed patterns (FM1 to FM3) whose number corresponds to that of the slits 53-1 to 53-3 (three in the case being described) are obtained on the phosphor screen 56.

The above-described prior art framing camera needs more than one slit to obtain a plurality of framed patterns. In addition, the number of framed patterns is uniquely determined by the number of slits and cannot be readily changed. As a further problem, the interval between individual framed patterns and the frame time are uniquely determined by the speed at which electron beams are swept by the deflectors 52 and 55 and this limits the flexibility in operation of the framing camera.

SUMMARY OF THE INVENTION

An object, therefore, of the present invention is to provide a framing camera having improved operational flexibility in that it is capable of producing a desired number of framed patterns with great ease and that the spacing between individual framed patterns and the frame time can be adjusted independently of each other.

The object of the present invention can be attained by a framing camera which comprises a photocathode, first electron lens means for focusing electron beams emitted from the photocathode onto a slit member, first deflection means for scanning the electron beams from the photocathode, the slit member having a slit from which the electron beams scanned with the first deflection means emerge as a temporal sequence, second electron lens means for focusing electron beams passed from the slit member onto a phosphor screen, and second deflection means for scanning the electron beams from the slit to have them impinge upon the phosphor screen, said first deflection means being supplied with a deflection voltage that is adjustable independently of the deflection voltage to be applied to said second deflection means.

In the framing camera of the present invention, electron beams emitted from the photocathode are scanned by the first deflection means so that they are in turn passed through the slit in the slit member. As the electron beams pass through the slit, electron beams with original spatial picture image information are converted into those having the picture image information as a temporal sequence. The electron beams carrying the picture image information of temporal sequence are scanned by the second deflection means in such a way that the picture image information of temporal sequence is restored to the initial spatial picture image information to produce framed patterns on the phosphor screen. In the present invention, the first deflection means is supplied with a deflection voltage that is adjustable independently of the deflection voltage to be applied to the second deflection means, so the number of framed patterns to be produced on the phosphor screen can be freely selected. There are two additional advantages that result from the independent adjustment of the deflection voltages to be applied to the first and second deflection means: first, the frequency of the deflection voltage applied to the first deflection means can be varied to adjust the interval between framed patterns; secondly, the amplitude of the deflection voltage on the first deflection means can be altered to adjust the frame time.

BRIEF DESCRIPTION OF THE DRAWINGS

FIG. 2(*a*) is a diagram showing the waveform of a deflection voltage applied to a deflector 2;

FIGS. 2(*b*), (*c*) and (*d*) are diagrams showing the waveforms of deflection voltages that are applied to a deflector 5;

FIGS. 3(*a*) and (*b*) are diagrams showing the framed patterns that are obtained when deflector 5 is supplied with deflection voltages having the waveforms shown in FIGS. 2(*c*) and (*d*), respectively;

FIGS, 5(*a*), (i b) and (*c*) are diagrams showing the waveforms of deflection voltages that are respectively applied to deflectors 2, 5 and 10 shown in FIG. 4; and FIG. 6 is a schematic representation of a prior art framing camera.

DETAILED DESCRIPTION OF THE PREFERRED EMBODIMENTS

Figure 1:
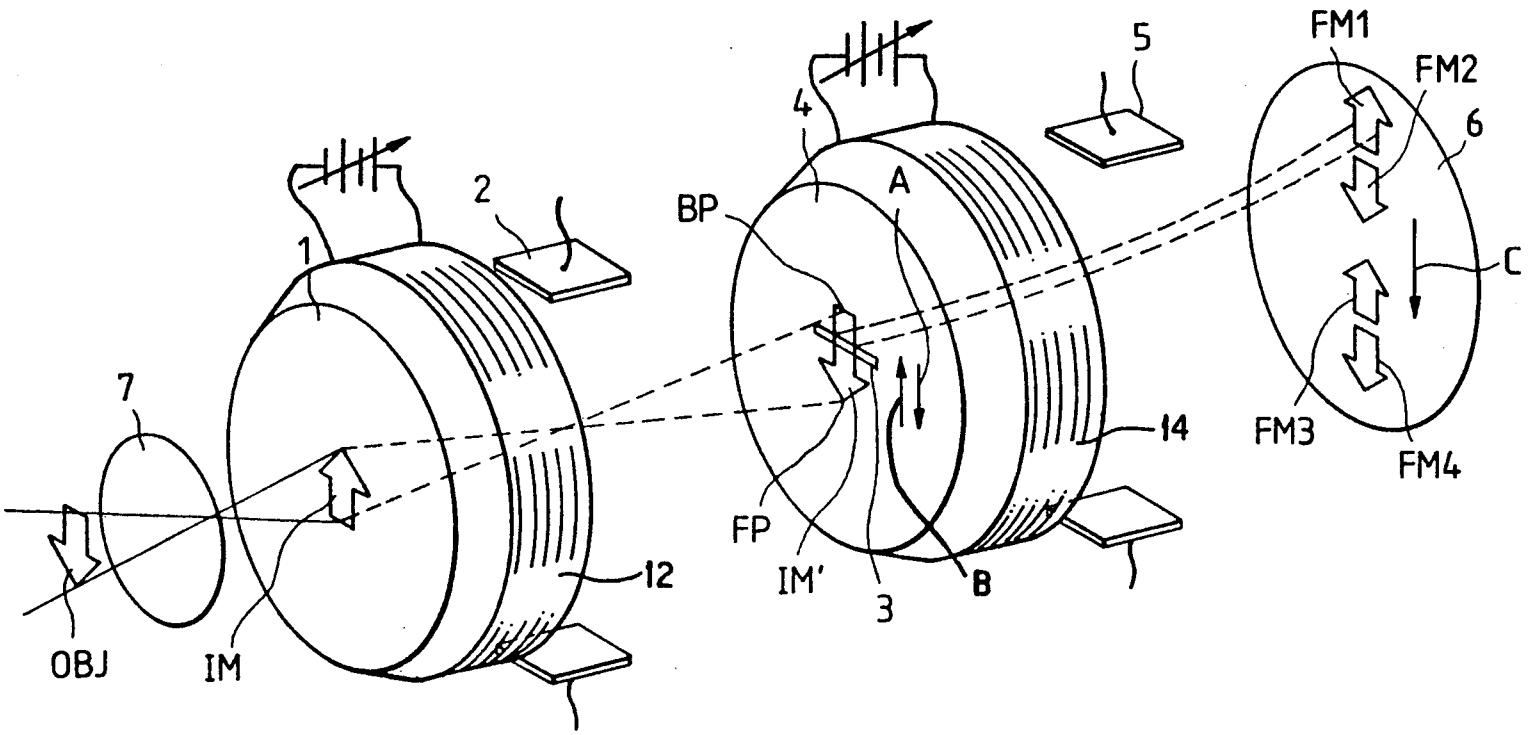
FIG. 1 is a schematic representation of a framing camera according to a first embodiment of the present invention.

FIG. 1 is a schematic representation of a framing camera according to a first embodiment of the present invention.

The framing camera shown in FIG. 1 comprises a photocathode 1, a deflector 2 for scanning electron beams emitted from the photocathode 1, a slit member 4 provided with a single slit 3, a deflector 5 for scanning electron beams passed from the slit 3, and a phosphor screen 6 to be irradiated with the electron beams scanned by the deflector 5. Also incorporated are an electron lens 12 for focusing the electron beams from the photocathode 1 onto the slit member 4, and an electron lens 14 for focusing the electron beams from the slit 3 onto the phosphor screen 6. The deflectors 2 and 5 are supplied with predetermined deflection voltages that are adjustable independently of each other. Each of the deflectors 2 and 5 may be composed of deflection plates or coils.

The operation of the framing camera having this arrangement will proceed as follows. When a light beam carrying the picture image information of an object OBJ irradiates the photocathode 1 through a lens 7, the photocathode 1 emits electron beams having spatial picture image information IM. The emitted electron beams are focused on the slit member 4 and part of the picture image information IM' carried by them passed through the slit 3 in the slit member 4.

Suppose here that the deflector 2 is supplied with a deflection voltage $V_1$ having the waveform shown in FIG. 2(*a*). The picture image information IM' then moves on the slit member 4 either downward (as indicated by arrow A) or upward (as indicated by arrow B), so that parts of the picture image information IM' are sequentially outputted from the slit 3. With reference to FIG. 2(*a*), the deflection voltage $V_1$ changes in polarity from positive to negative during time periods $t_1$ and $t_3$, so the picture image information IM' will move in the direction indicated by arrow A and sequential time-developed outputs will emerge from the slit 3, the front portion FP of IM' coming first and the back portion BP coming last. During time periods $t_2$ and $t_4$, the deflection voltage $V_1$ changes in polarity from negative to positive, so IM' will move in the direction indicated by arrow B and sequential time-developed outputs will emerge from the slit 3, the back portion BP of IM' coming first and the front portion FP coming the last.

The picture image information of temporal sequence outputted from the slit 3 is restored to spatial picture image information by the deflection voltage on the deflector 5 and forms framed patterns on the phosphor screen 6. Suppose here that the deflector 5 is supplied with a ramp deflection voltage $V_{21}$ which, as shown in FIG. 2(*b*), changes in polarity from positive to negative over a period (i.e., falling period) 2T which is twice the period T of the deflection voltage $V_1$. Since the period 2T contains the four period $t_1$, $t_2$, $t_3$ and $t_4$ of voltage $V_1$, four framed patterns FM1 to FM4 that correspond to the outputs of the picture image information IM' that are produced in these respective periods $t_1$ to $t_4$ are obtained as time passes in a column on the phosphor screen 6 in the order indicated by arrow C. The front and back portions of these four framed patterns FM1 to FM4 are alternately reversed depending upon the deflecting direction of the voltage $V_1$.

If the deflector 5 is supplied with a ramp deflection voltage $V_{22}$ having the waveform shown in FIG. 2(*c*), three framed patterns will be obtained in a column on the phosphor screen 6 as shown in FIG. 3(*a*). If the deflector 5 is supplied with a ramp deflection voltage $V_{23}$ having the waveform shown in FIG. 2(*d*), two framed patterns will be obtained in a column on the phosphor screen 6 as shown in FIG. 3(*b*).

As described above, the first embodiment of the present invention offers the advantage that a desired number of framed patterns can be obtained from a single slit 3 with great ease by adjusting the falling period of the ramp deflection voltage on the deflector 5 with respect to the period of the deflection voltage $V_1$ on the deflector 2. As a further advantage, the interval between individual framed patterns and the frame time can be adjusted independently of each other by appropriately selecting the amplitude and frequency of the deflection voltage $V_1$ on the deflector 2. Stated more specifically, the interval between framed patterns can be adjusted by changing the frequency of $V_1$, and the frame time can be adjusted by changing the amplitude of $V_1$. In FIG. 2(*a*), $V_1$ is shown to be of a sine wave but it may be of a rectangular wave.

Figure 4:
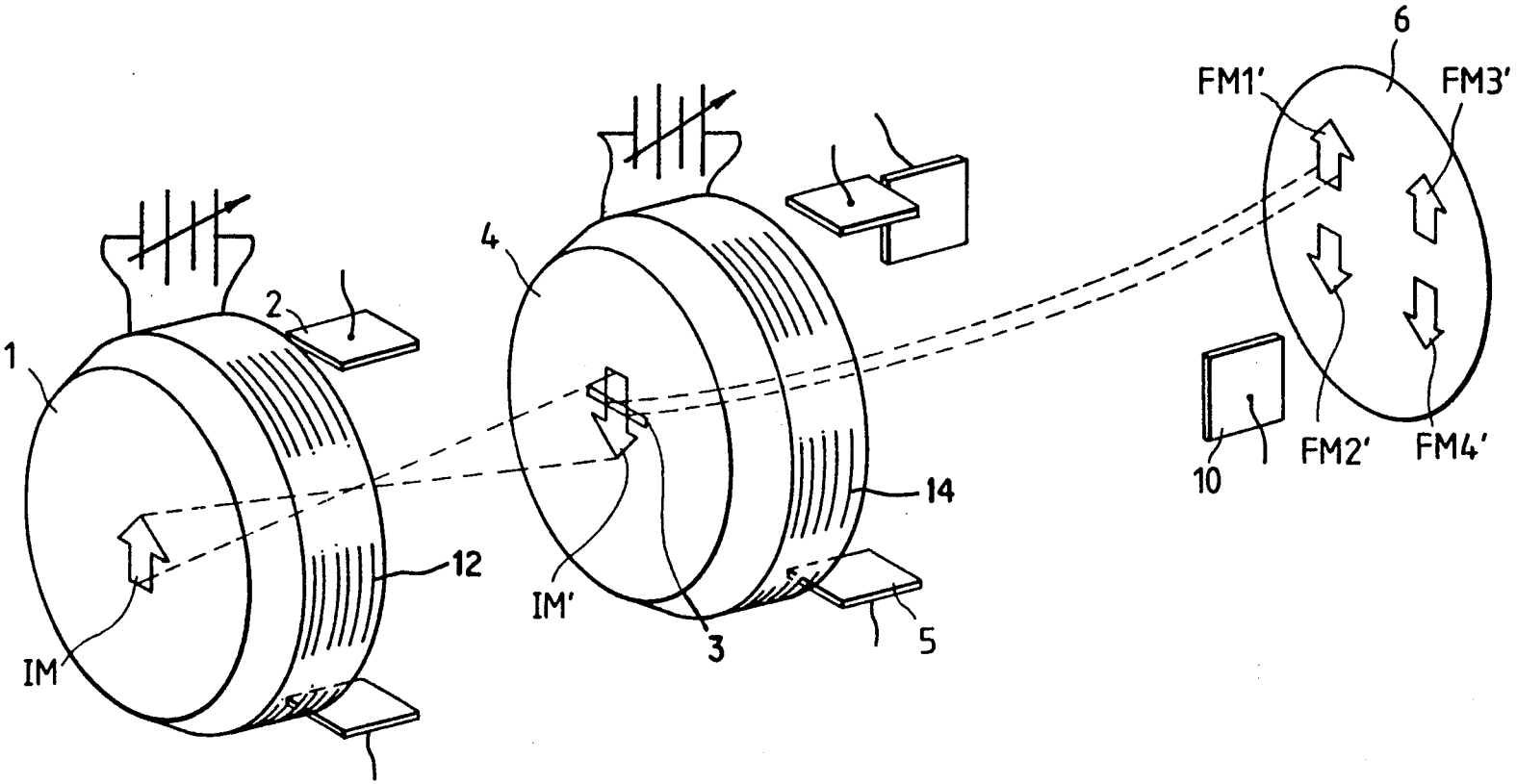
FIG. 4 is a schematic representation of a framing camera according to a second embodiment of the present invention.

FIG. 4 is a schematic representation of a framing camera according to a second embodiment of the present invention. In FIG. 4, the portions which correspond to those shown in FIG. 1 are identified by like numerals and will not be described in detail.

The framing camera shown in FIG. 4 is characterized by the insertion of a deflector 10 between the deflector 5 and the phosphor screen 6, which imparts deflection in a direction perpendicular to the deflection provided by the deflector 5. As in the first embodiment, the deflection voltage to be applied to the deflectors 2 and 4 are adjustable independently of each other in the second embodiment. In addition, the deflector 10 is supplied with a deflection voltage that is adjustable independently of the deflection voltages to be applied to the deflectors 2 and 5.

Assume here that the deflectors 2, 5 and 10 are respectively supplied with deflection voltages $V_a$, $V_b$ and $V_c$ having the waveforms shown in FIGS. 5(*a*), (*b*) and (*c*). Then, framed patterns FM1' and FM2' are produced on the left side of the phosphor screen 6 during periods $s_1$ and $s_2$, and framed patterns FM3' and FM4' are produced on the right side of the phosphor screen 6 during periods $s_4$ and $s_5$. In other words, a plurality of framed patterns can be produced not only in columns but also in rows by reversing the polarity of the deflection voltage $V_c$ at a suitable point of time in a period $s_3$ as shown in FIG. 5(*c*). If desired, more than two framed patterns can be obtained in a horizontal direction by supplying the deflector 10 with a step deflection voltage.

As described above, in accordance with the second embodiment of the present invention, the deflectors 2, 5 and 10 are supplied with independently adjusted deflection voltages and this allows a plurality of framed patterns to be produced easily in a desired two-dimensional array. The number of framed patterns can be increased to the extent that is permitted by the resolution of the phosphor screen 6.

As described on the foregoing pages, the first and second deflection means in the framing camera of the present invention are supplied with deflection voltages that are adjustable independently of each other, and this contributes to great flexibility in the operation of the framing camera.

What is claimed is:

1. A framing camera, comprising:

a photocathode for receiving a first optical image and emitting first electron beams with a spatial image corresponding to said first optical image;

a slit member having a slit;

first electron lens means for focusing said first electron beams onto said slit member;

first deflection means for scanning said first electron beams in response to a first deflection voltage, said first deflection voltage having a corresponding time varying portion;

said slit passing part of said first electron beams deflected by said first deflection means as a temporal sequence of second electron beams;

a phosphor screen for receiving said second electron beams and converting said second electron beams into optical images;

second electron lens means for focusing said second electron beams onto said phosphor screen; and second deflection means for scanning said second electron beams in response to a second deflection voltage, said second deflection voltage having a corresponding time varying portion, said corresponding time varying portions of said first and second voltages having different phases and periods;

wherein second optical images of a plurality of framed patterns are formed on said phosphor screen.

2. A framing camera as claimed in claim 1, wherein scanning directions of said first and second deflection means are parallel to each other.

3. A framing camera as claimed in claim 1, wherein said second deflection means comprises;

a first deflector for scanning said second electron beams in a direction parallel to a scanning direction of said first deflection means; and a second deflector for scanning said second electron beams in a direction perpendicular to a scanning direction of said first deflection means.

4. A framing camera as claimed in claim 3, wherein deflection voltages applied to said first and second deflectors are adjustable independently of each other.

5. A method of forming a plurality of framed patterns using a framing camera including a photocathode, a slit member, electron lens means, first deflection means, a phosphor screen, and second deflection means, the method of forming a plurality of framed patterns comprising the steps of:

receiving, by the photocathode, a first optical image;

emitting, by the photocathode, first electron beams with a spatial image corresponding to said first optical image;

focusing, by said electron lens means, said first electron beams onto the slit member;

generating a first deflection voltage and a second deflection voltage, each of said voltages including a time varying portion, waveforms of said corresponding time varying portions having different phases and periods;

scanning, by the first deflection means, said first electron beams in response to said first deflection voltage;

passing, by said slit member, part of said first electron beams deflected by the first deflection means as a temporal sequence of second electron beams;

scanning, by said second deflection means, said second electron beams in response to said second deflection voltage;

receiving, by the phosphor screen, said second electron beams; and converting, by the phosphor screen, said second electron beams into second optical images of a plurality of framed patterns.

* * * * *